US007756713B2

(12) United States Patent
Chong et al.

(10) Patent No.: US 7,756,713 B2
(45) Date of Patent: Jul. 13, 2010

(54) AUDIO SIGNAL DECODING DEVICE WHICH DECODES A DOWNMIX CHANNEL SIGNAL AND AUDIO SIGNAL ENCODING DEVICE WHICH ENCODES AUDIO CHANNEL SIGNALS TOGETHER WITH SPATIAL AUDIO INFORMATION

(75) Inventors: Kok Seng Chong, Singapore (SG); Naoya Tanaka, Osaka (JP); Sua Hong Neo, Singapore (SG); Mineo Tsushima, Nara (JP)

(73) Assignee: Panasonic Corporation, Osaka (JP)

( * ) Notice: Subject to any disclaimer, the term of this patent is extended or adjusted under 35 U.S.C. 154(b) by 822 days.

(21) Appl. No.: 11/629,135

(22) PCT Filed: Jun. 28, 2005

(86) PCT No.: PCT/JP2005/011842

§ 371 (c)(1),
(2), (4) Date: Dec. 11, 2006

(87) PCT Pub. No.: WO2006/003891

PCT Pub. Date: Jan. 12, 2006

(65) Prior Publication Data

US 2008/0071549 A1 Mar. 20, 2008

(30) Foreign Application Priority Data

Jul. 2, 2004 (JP) ..... 2004-197336

(51) Int. Cl.
*G10L 19/00* (2006.01)

(52) U.S. Cl. ..... 704/500

(58) Field of Classification Search ..... 704/500
See application file for complete search history.

(56) References Cited

U.S. PATENT DOCUMENTS 5,640,385 A 6/1997 Long et al.

(Continued)

FOREIGN PATENT DOCUMENTS

JP 6-105824 4/1994

(Continued)

OTHER PUBLICATIONS

Supplementary European Search Report issued Sep. 23, 2009 in corresponding European Patent Application No. 05 76 5247.

(Continued)

*Primary Examiner*—Susan McFadden
(74) *Attorney, Agent, or Firm*—Wenderoth, Lind & Ponack, L.L.P.

(57) ABSTRACT

In the conventional art inventions for coding multi-channel audio signals, three of the major processes involved are: generation of a reverberation signal using an all-pass filter; segmentation of a signal in the time and frequency domains for the purpose of level adjustment; and mixing of a coded binaural signal with an original signal coded up to a fixed crossover frequency. These processes pose the problems mentioned in the present invention. The present invention proposes the following three embodiments: to control the extent of reverberations by dynamically adjusting all-pass filter coefficients with the inter-channel coherence cues; to segment a signal in the time domain finely in the lower frequency region and coarsely in the higher frequency region; and to control a crossover frequency used for mixing based on a bit rate, and if the original signal is coarsely quantized, to mix a downmix signal with an original signal in proportions determined by an inter-channel coherence cue.

15 Claims, 7 Drawing Sheets

U.S. PATENT DOCUMENTS

| | | | | |
|---|---|---|---|---|
| 6,252,965 | B1 | 6/2001 | Beard | |
| 6,985,594 | B1 | 1/2006 | Vaudrey et al. | |
| 7,299,190 | B2 * | 11/2007 | Thumpudi et al. | 704/500 |
| 7,502,743 | B2 * | 3/2009 | Thumpudi et al. | 704/500 |
| 2003/0035553 | A1 | 2/2003 | Baumgarte et al. | |
| 2003/0219130 | A1 | 11/2003 | Baumgarte et al. | |
| 2003/0235317 | A1 | 12/2003 | Baumgarte | |
| 2003/0236583 | A1 | 12/2003 | Baumgarte et al. | |

FOREIGN PATENT DOCUMENTS

| | | |
|---|---|---|
| JP | 9-102742 | 4/1997 |
| JP | 9-507734 | 8/1997 |
| JP | 2003-522439 | 7/2003 |
| JP | 2005-523479 | 8/2005 |
| WO | 95/20277 | 7/1995 |
| WO | 00/78093 | 12/2000 |
| WO | 03/007656 | 1/2003 |
| WO | 03/090207 | 10/2003 |
| WO | 03/090208 | 10/2003 |

OTHER PUBLICATIONS

Baumgarte, F., et al. "*Audio Coder Enhancement using Scalable Binaural Cue Coding with Equalized Mixing*", Preprints of Papers Presented at the AES Convention, XX, XX, May 8, 2004, pp. 1-9, XP009055857.

Breebaart, J., et al. "High-quality parametric spatial audio coding at low bitrates", Preprints of Papers Presented at the AES Convention, XX, XX, May 8, 2004, pp. 1-13, XP009042418.

ISO/IEC 14496-3:2001/FDAM2, "*Parametric Coding for High Quality Audio*", Dec. 2003, pp. iii-116.

* cited by examiner

AUDIO SIGNAL DECODING DEVICE WHICH DECODES A DOWNMIX CHANNEL SIGNAL AND AUDIO SIGNAL ENCODING DEVICE WHICH ENCODES AUDIO CHANNEL SIGNALS TOGETHER WITH SPATIAL AUDIO INFORMATION

TECHNICAL FIELD

The present invention relates to a coding device which, in a coding process, extracts binaural cues from audio signals and generates a downmix signal, and an audio signal decoding device which, in a decoding process, decodes the downmix signal into multi-channel audio signals by adding the binaural cues to the downmix signal.

The present invention relates to a binaural cue coding method whereby a Quadrature Mirror Filter (QMF) bank is used to transform multi-channel audio signals into time-frequency (T/F) representations in the coding process.

BACKGROUND ART

The present invention relates to coding and decoding of multi-channel audio signals. The main object of the present invention is to code digital audio signals while maintaining the perceptual quality of the digital audio signals as much as possible, even under the bit rate constraint. A reduced bit rate is advantageous in terms of reduction in transmission bandwidth and storage capacity.

A number of conventional arts suggest methods for achieving bit rate reduction as mentioned above.

In the "mid-side (MS) stereo" approach, stereo channels L and R are represented in the form of their "sum" (L+R) and "difference" (L−R) channels. If the stereo channels are highly correlated, the "difference" signal contains insignificant information that can be coarsely quantized with fewer bits than the "sum" signal. In the extreme case such as L=R, no information needs to be transmitted for the difference signal.

In the "intensity stereo" approach, psychoacoustic properties of the ear are exploited, and only the "sum" signal is transmitted for the high frequency region, together with frequency-dependent scale factors, which are to be applied to the "sum" signal at the decoder so as to synthesize the L and R channels.

In the "binaural cue coding" approach, binaural cues are generated to shape a downmix signal in the decoding process. The binaural cues are, for example, inter-channel level/intensity difference (ILD), inter-channel phase/delay difference (IPD), and inter-channel coherence/correlation (ICC), and the like. The ILD cue measures the relative signal power; the IPD cue measures the difference in sound arrival time to the ears; and the ICC cue measures the similarity. In general, the level/intensity cue and phase/delay cue control the balance and lateralization of sound, whereas the coherence/correlation cue controls the width and diffusiveness of the sound. These cues are, in totality, spatial parameters that help the listener mentally compose an auditory scene.

FIG. 1 is a diagram which shows a typical codec (coding and decoding) that employs a coding and decoding method in the binaural cue coding approach. In the coding process, an audio signal is processed on a frame-by-frame basis. A downmix unit (500) downmixes the left and right channels L and R to generate M=(L+R)/2. A binaural cue extraction module (502) processes the L, R and M to generate binaural cues. The binaural cue extraction module (502) usually includes a time-frequency transform module. This time-frequency transform module transforms L, R and M into, for example, fully spectral representations through FFT, MDCT or the like, or hybrid time-frequency representations through QMF or the like. Alternatively, M can be generated from L and R after spectral transform thereof by taking the average of the spectral representations of L and R. Binaural cues can be obtained by comparing these representations of L, R and M on a spectral band, on a spectral band basis.

An audio encoder (504) codes the M signal to generate a compressed bit stream. Some examples of this audio encoder are encoders for MP3, AAC and the like. The binaural cues are quantized and multiplexed with the compressed M at (506) to form a complete bit stream. In the decoding process, a demultiplexer (508) demultiplexes the bit stream of M from the binaural cue information. An audio decoder (510) decodes the bit stream of M to reconstruct the downmix signal M. A multi-channel synthesis module (512) processes the downmix signal and the dequantized binaural cues to reconstruct the multi-channel signals. Documents related to the conventional arts are as follows:

Non-patent Reference 1: [1] ISO/IEC 14496-3:2001/FDAM2, "Parametric Coding for high Quality Audio"

Patent Reference 1: [2] WO03/007656A1, "Efficient and Scalable Parametric Stereo Coding for Low Bitrate Application"

Patent Reference 2: [3] WO03/090208A1, "Parametric Representation of Spatial Audio"

Patent Reference 3: [4] U.S. Pat. No. 6,252,965B1, "Multichannel Spectral Mapping Audio Apparatus and Method"

Patent Reference 4: [5] US2003/0219130A1, "Coherence-based Audio Coding and Synthesis"

Patent Reference 5: [6] US2003/0035553A1, "Backwards-Compatible Perceptual Coding of Spatial Cues"

Patent Reference 6: [7] US2003/0235317A1, "Equalization For Audio Mixing"

Patent Reference 7: [8] US2003/0236583A1, "Hybrid Multi-channel/Cue Coding/Decoding of Audio Signals"

DISCLOSURE OF INVENTION

Problems that Invention is to Solve

In the conventional art [1] (see Non-patent Reference 1), sound diffusiveness is achieved by mixing a downmix signal with a "reverberation signal". The reverberation signal is derived from processing the downmix signal using a Shroeder's all-pass link. The coefficients of this filter are all determined in the decoding process. When the audio signal contains fast changing characteristics, in order to remove excessive echo effects, this reverberation signal is separately subjected to a transient attenuation process to reduce the extent of reverberation. However, this separate filtering process incurs extra computational load.

In the conventional art [5] (see Patent Reference 4), sound diffusiveness (i.e. surround effect) is achieved by inserting "random sequences" into the ILD and IPD cues. The random sequences are controlled by the ICC cues.

FIG. 2 is a diagram which shows a conventional and typical time segmentation method. To compute the ILD cues, the conventional art [1] divides the T/F representations of L, R and M into time segments (delimited by "time borders" 601), and computes one ILD for each time segment. However, this approach does not fully exploit the psychoacoustic properties of the ear.

In the conventional art [1], binaural cue coding is applied to the entire frequency spectrum of a downmix signal. However, this approach is not good enough to achieve "crystal-clear" sound quality at a high bit rate. The conventional art [8] (see Patent Reference 7) proposes that an original audio signal be coded at a frequency lower than 1.5 kHz when a bit rate is high. However, using a fixed crossover frequency (i.e. 1.5 kHz) is not advantageous because the optimum sound quality cannot be achieved at intermediate bit rates.

It is an object of the present invention to improve the conventional binaural cue coding approaches.

Means to Solve the Problems

The first embodiment of the present invention proposes that the extent of reverberations be directly controlled by modifying the filter coefficients that have an effect on the extent of reverberations. It further proposes that these filter coefficients be controlled using the ICC cues and by a transient detection module.

In the second embodiment, it proposes that T/F representations are divided first in the spectral direction into plural "sections". The maximum number of time borders allowed for each section differs, such that fewer time borders are allowed for sections in a high frequency region. In this manner, finer signal segmentation can be carried out in the low frequency region so as to allow more precise level adjustment while suppressing the surge in bit rate.

The third embodiment proposes that the crossover frequency be changed adaptively to the bit rate. It further proposes an option to mix an original audio signal with a downmix signal at a low frequency when it is expected that the original audio signal has been coarsely coded owing to bit rate constraint. It further proposes that the ICC cues be used to control the proportions of mixing.

EFFECTS OF THE INVENTION

The present invention successfully reproduces the distinctive multi-channel effect of the original signals compressed in the coding process in which binaural cues are extracted and the multi-channel original signals are downmixed. The reproduction is made possible by adding the binaural cues to the downmix signal in the decoding process.

NUMERICAL REFERENCES

Figure 1:
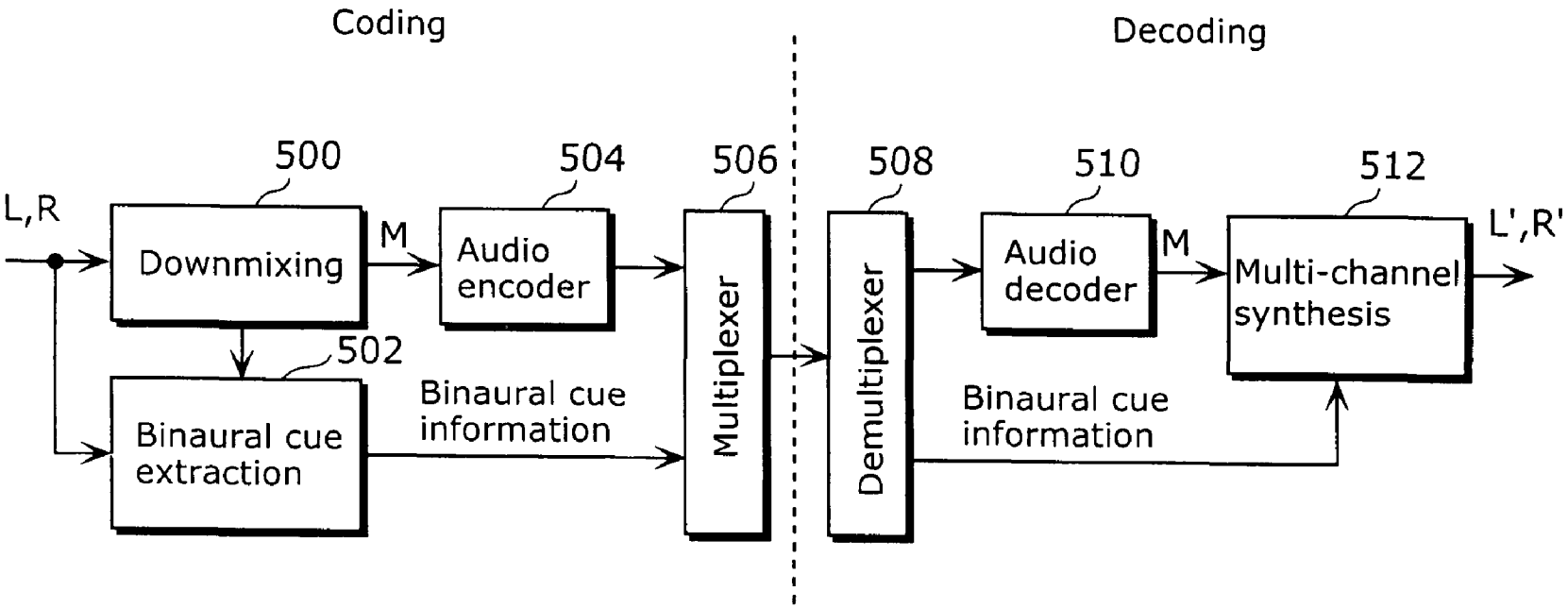
FIG. 1 is a diagram which shows a configuration of a conventional and typical binaural cue coding system.

100 Transform module
102 Downmix module
104 Energy envelope analyzer
106 Module which computes IPDL(b)
108 Module which computes IPDR(b)
110 Module which computes ICC(b)
200 Transform module
202 Reverberation generator
204 Transient detector
206, 208 Phase adjusters
210, 212 Mixers 2
214, 216 Energy adjusters
218 Inverse transform module
300 Transform module
302 Reverberation generator
304 Transient detector
306, 308 Phase adjusters
310, 312 Mixers 2
314, 316 Energy adjusters
318 Inverse transform module
320 Low-pass filter
322, 324 Mixers 1
326 High-pass filter
400 Frequency band
402 Section 0
404 Section 2
406 Border
410 Downmix unit
411 AAC encoder
412 Binaural cue encoder
413 Second encoder
414 AAC decoder
415 Premix unit
416 Signal separation unit
417 Mixing unit
418 Channel separation unit
419 Phase adjustment unit
500 Downmix unit
502 Binaural cue extraction unit
504 Audio encoder
506 Multiplexer
508 Demultiplexer
510 Audio decoder
512 Multi-channel synthesis unit
601 Border

BEST MODE FOR CARRYING OUT THE INVENTION

First Embodiment

The following embodiments are merely illustrative for the principles of various inventive steps of the present invention. It is understood that variations of the details described herein will be apparent to those skilled in the art. It is the intent of the present invention, therefore, to be limited only by the scope of the patent claims, and not by the specific and illustrative details herein.

Furthermore, although only a stereo/mono case is shown here, the present invention is by no means limited to such a case. It can be generalized to M original channels and N downmix channels.

Figure 3:
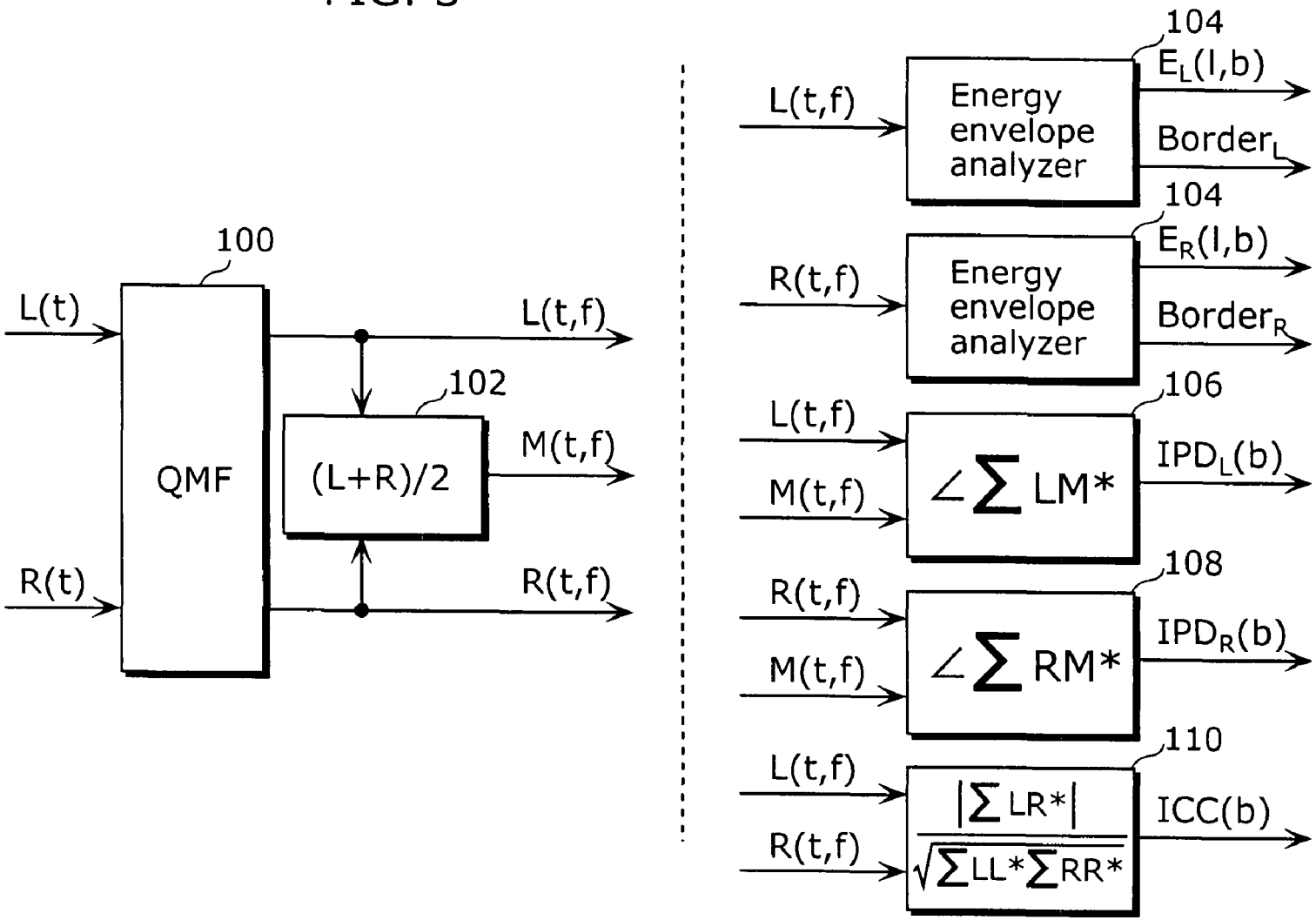
FIG. 3 is a block diagram which shows a configuration of a coding device according to the present invention.

FIG. 3 is a block diagram which shows a configuration of a coding device of the first embodiment. FIG. 3 illustrates a coding process according to the present invention. The coding device of the present embodiment includes: a transform module 100; a downmix module 102; two energy envelope analyzers 104 for L(t, f) and R(t, f); a module 106 which computes an inter-channel phase cue IPDL(b) for the left channel; a module 108 which computes IPDR(b) for the right channel; and a module 110 for computing ICC(b). The transform module (100) processes the original channels represented as time functions L(t) and R(t) hereinafter. It obtains their respective time-frequency representations L(t, f) and R(t, f). Here, t denotes a time index, while f denotes a frequency index. The transform module (100) is a complex QMF filterbank, such as that used in MPEG Audio Extensions 1 and 2. L(t, f) and R(t, f) contain multiple contiguous subbands, each representing a narrow frequency range of the original signals. The QMF bank can be composed of multiple stages, because it allows low frequency subbands to pass narrow frequency bands and high frequency subbands to pass wider frequency bands.

The downmix module (102) processes L(t, f) and R(t, f) to generate a downmix signal, M(t, f). Although there are a number of downmixing methods, a method using "averaging" is shown in the present embodiment.

Figure 4:
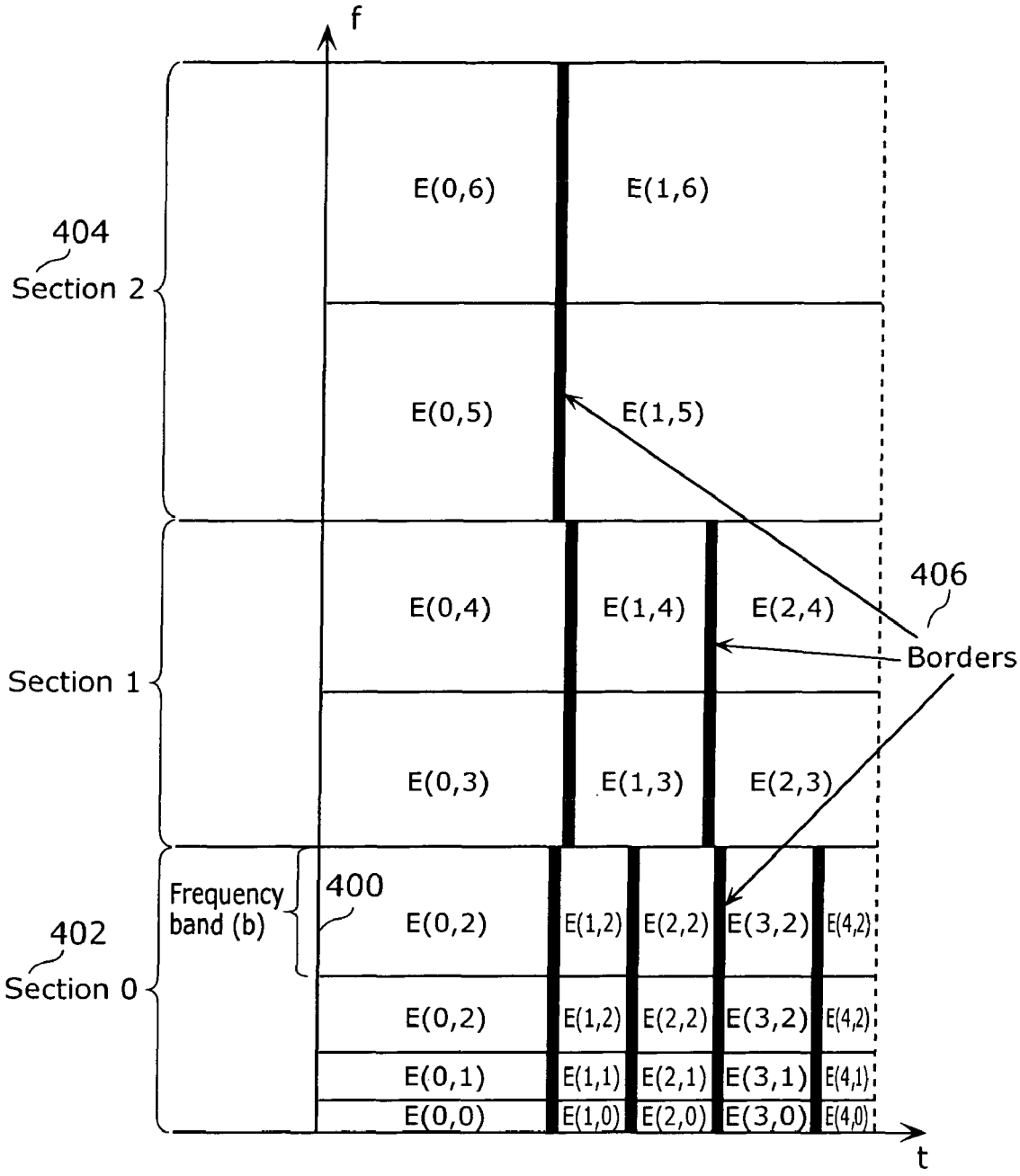
FIG. 4 is a diagram which shows a time segmentation method for various frequency sections.

In the present invention, energy cues instead of ILD cues are used to achieve level adjustment. To compute the energy cue, the left-channel energy envelope analyzing module (104) further processes L(t, f) to generate an energy envelope EL(l, b) and Border L. FIG. 4 is a diagram which shows how to segment L(t, f) into time-frequency sections in order to adjust the energy envelope of a mixed audio channel signal. As shown in FIG. 4, the time-frequency representation L(t, f) is first divided into multiple frequency bands (400) in the frequency direction. Each band includes multiple subbands. Exploiting the psychoacoustic properties of the ear, the lower frequency band consists of fewer subbands than the higher frequency band. For example, when the subbands are grouped into frequency bands, the "Bark scale" or the "critical bands" which are well known in the field of psychoacoustics can be used.

L(t, f) is further divided into frequency bands (l, b) in the time direction by Borders L, and EL(l, b) is computed for each band. Here, "l" is a time segment index, whereas "b" is a band index. Border L is best placed at a time location where it is expected that a sharp change in energy of L(t, f) takes place, and a sharp change in energy of the signal to be shaped in the decoding process takes place.

In the decoding process, EL(l, b) is used to shape the energy envelope of the downmix signal on a band-by-band basis, and the borders between the bands are determined by the same critical band borders and the Borders L. The energy EL(l, b) is defined as:

$$E_L(l, b) = \sum^{f \subset b} \sum^{t \subset l} |L(t, f)|^2 \quad \text{[Equation 1]}$$

In the same manner, the right-channel energy envelope analyzing module (104) processes R(t, f) to generate ER(l, b) and Border R.

To obtain the inter-channel phase cues for the left channel, the left inter-channel phase cue computation module (106) processes L(t, f) and M(t, f) to obtain IPDL(b) using the following equation:

$$IPD_L(b) = \angle \sum^{f \subset b} \sum^{t \subset FRAMESIZE} L(t, f) M^*(t, f) \quad \text{[Equation 2]}$$

Here, M*(t, f) denotes the complex conjugate of M(t, f). The right inter-channel phase cue computation module (108) computes the inter-channel phase cue IPDR(b) in the same manner:

$$IPD_R(b) = \angle \sum^{f \subset b} \sum^{t \subset FRAMESIZE} R(t, f) M^*(t, f) \quad \text{[Equation 3]}$$

Finally, to obtain the inter-channel coherence cue between the right and left channels in the coding process, the module (110) processes L(t, f) and R(t, f) to obtain ICC(b) using the following equation:

$$ICC(b) = \frac{\left| \sum^{f \subset b} \sum^{t \subset FRAMESIZE} L(t, f) R^*(t, f) \right|}{\sqrt{\sum^{f \subset b} \sum^{t \subset FRAMESIZE} L(t, f) L^*(t, f)} \sqrt{\sum^{f \subset b} \sum^{t \subset FRAMESIZE} R(t, f) R^*(t, f)}} \quad \text{[Equation 4]}$$

All of the above binaural cues are to become a part of the side information in the coding process.

Figure 5:
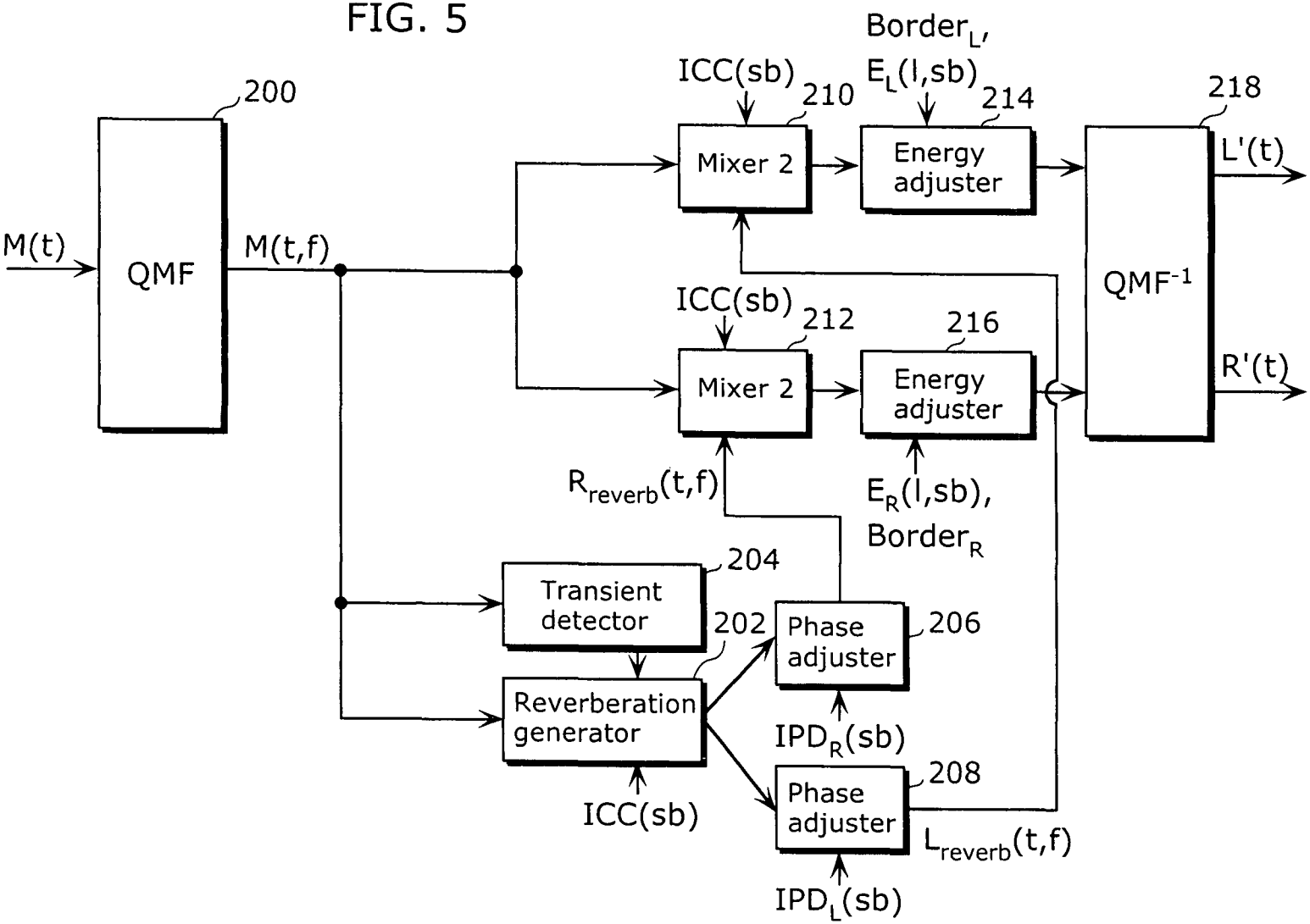
FIG. 5 is a block diagram which shows a configuration of a decoding device according to the first embodiment of the present invention.

FIG. 5 is a block diagram which shows a configuration of a decoding device of the first embodiment. The decoding device of the first embodiment includes a transform module (200), a reverberation generator (202), a transient detector (204), phase adjusters (206, 208), mixers 2 (210, 212), energy adjusters (214, 216), and an inverse-transform module (218). FIG. 5 illustrates an implementable decoding process that utilizes the binaural cues generated as above. The transform module (200) processes a downmix signal M(t) to transform it into its time-frequency representation M(t, f). The transform module (200) shown in the present embodiment is a complex QMF filterbank.

The reverberation generator (202) processes M(t, f) to generate a "diffusive version" of M(t, f), known as MD(t, f). This diffusive version creates a more "stereo" impression (or "surround" impression in the multi-channel case) by inserting "echoes" into M(t, f). The conventional arts show many devices which generate such an impression of reverberation, just using delays or fractional-delay all-pass filtering. The present invention utilizes fractional-delay all-pass filtering in order to achieve a reverberation effect. Normally, a cascade of multiple all-pass filters (known as a Schroeder's All-pass Link) is employed:

$$H_f(z) = \prod_{m=0}^{m=L-1} \frac{Q(f, m) z^{-d(m)} - \text{slope}(f, m)}{1 - \text{slope}(f, m) Q(f, m) z^{-d(m)}} \quad \text{[Equation 5]}$$

where L is the number of links, d(m) is the filter order of each link. They are usually designed to be mutually prime. Q(f, m) introduces fractional delays that improve echo densities, whereas slope(f, m) controls the rate of decay of the reverberations. The larger slope(f, m) is, the slower the reverberations decay. The specific process for designing these parameters is outside the scope of the present invention. In the conventional arts, these parameters are not controlled by binaural cues.

The method of controlling the rate of decay of reverberations in the conventional arts is not optimal for all signal characteristics. For example, if a signal consists of a fast changing signal "spikes", less reverberation is desired to avoid excessive echo effect. The conventional arts use a transient attenuation device separately to suppress some reverberations.

The final problem is that if the original signal is "mono" by nature (such as a mono speech), excessive reverberations might cause the decoded signal to sound very differently from the original signal. There is neither conventional art method nor device that solves this problem.

In this invention, an ICC cue is used to adaptively control the slope(f, m) parameter. A new_slope(f, m) is used in place of slope(f, m) as follows to remedy the above problem:

$$H_f(z) = \prod_{m=0}^{m=L-1} \frac{Q(f,m)z^{-d(m)} - \text{new_slope}(f,m)}{1 - \text{new_slope}(f,m)Q(f,m)z^{-d(m)}} \quad \text{[Equation 6]}$$

Here, new_slope(f, m) is defined as an output function of the transient detection module (204), and ICC(b) is defined as follows:

$$\text{new_slope}(f,m)=\text{slope}(f,m)*(1-\alpha\cdot ICC(b))*Tr_\text{flag}(b) \quad \text{[Equation 7]}$$

where $\alpha$ is a tuning parameter. If a current frame of a signal is mono by nature, its ICC(b), which measures the correlation between the left and right channels in that frame, would be rather high. In order to reduce reverberations, slope(f, m) would be greatly reduced by (1−ICC(b)), and vice versa.

If a current frame of a signal consists of fast changing signal spikes, the transient detection module (204) would return a small Tr_flag(b), such as 0.1, to reduce slope(f, m), thereby causing less reverberation. On the other hand, if a current frame is a smoothly changing signal, the transient detection module (204) would return a large Tr_flag(b) value, such as 0.99. That helps preserve the intended amount of reverberations. Tr_flag(b) can be generated by analyzing M(t, f) in the decoding process. Alternatively, Tr_flag(b) can be generated in the coding process and transmitted, as side information, to the decoding process side.

Expressed in the z-domain, the reverberation signal MD(t, f) is generated by convoluting M(t, f) with Hf(z) (convolution is multiplication in the z-domain).

$$M_D(z,f)=M(z,f)*H_f(z) \quad \text{[Equation 8]}$$

Lreverb(t, f) and Rreverb(t, f) are generated by applying the phase cues IPDL(b) and IPDR(b) on MD(t, f) in the phase adjustment modules (206) and (208) respectively. This process recovers the phase relationship between the original signal and the downmix signal in the coding process.

The equations applied are as follows:

$$L_{reverb}(t,f)=M_D(t,f)*e^{IPD_L(b)}$$

$$R_{reverb}(t,f)=M_D(t,f)*e^{IPD_R(b)} \quad \text{[Equation 9]}$$

The phase applied here can also be interpolated with the phases of previously processed audio frames before applying the phases. Using Lreverb(t, f) as an example, the equation used in the left channel phase adjustment module (208) can be changed to:

$$L_{reverb}(t,f)=M_D(t,f)*\{a_{-2}e^{IPD_L(\hat{fr}-2,b)}+a_{-1}e^{IPD_L(\hat{fr}-1,b)}+a_0e^{IPD_L(\hat{fr},b)}\} \quad \text{[Equation 10]}$$

where a-2, a-1 and a0 are interpolating coefficients and fr denotes an audio frame index. Interpolation prevents the phases of Lreverb(t, f) from changing abruptly, thereby improving the overall stability of sound.

Interpolation can be similarly applied in the right channel phase adjustment module (206) to generate Rreverb(t, f) from MD(t, f).

Lreverb(t, f) and Rreverb(t, f) are shaped by the left channel energy adjustment module (214) and the right channel energy adjustment module (216) respectively. They are shaped in such a manner that the energy envelopes in various bands, as delimited by BorderL and BorderR, as well as predetermined frequency section borders (just like in FIG. 4), resemble the energy envelopes in the original signals. As for the left channel, a gain factor GL(l, b) is computed for a band (l, b) as follows:

$$G_L(l,b) = \sqrt{\frac{E_L(l,b)}{\sum_{t\subset l}\sum_{f\subset b}|L_{reverb}(t,f)|^2}} \quad \text{[Equation 11]}$$

The gain factor is then multiplied to Lreverb(t, f) for all samples within the band. The right channel energy adjustment module (216) performs the similar process for the right channel.

$$L_{adj}(t,f)=L_{reverb}(t,f)*G_L(l,b)$$

$$R_{adj}(t,f)=R_{reverb}(t,f)*G_R(l,b) \quad \text{[Equation 12]}$$

Since Lreverb(t, f) and Rreverb(t, f) are just artificial reverberation signals, it might not be optimal in some cases to use them as they are as multi-channel signals. In addition, although the parameter slope(f, m) can be adjusted to new_slope(f, m) to reduce reverberations to a certain extent, such adjustment cannot change the principal echo component determined by the order of the all-pass filter. The present invention provides a wider range of options for control by mixing Lreverb(t, f) and Rreverb(t, f) with the downmix signal M(t, f) in the left channel mixer (210) and the right channel mixer (212) which are mixing modules, prior to energy adjustment. The proportions of the reverberation signals Lreverb(t, f) and Rreverb(t, f) and the downmix signal M(t, f) can be, for example, controlled by ICC(b) in the following manner:

$$L_{reverb}(t,f)=(1-ICC(b))*L_{reverb}(t,f)+ICC(b)*M(t,f)$$

$$R_{reverb}(t,f)=(1-ICC(b))*R_{reverb}(t,f)+ICC(b)*M(t,f) \quad \text{[Equation 13]}$$

ICC(b) indicates the correlation between the left and right channels. The above equation mixes more M(t, f) into Lreverb (t, f) and Rreverb(t, f) when the correlation is high, and vice versa.

The module (218) inverse-transforms energy-adjusted Ladj(t, f) and Radj(t, f) to generate their time-domain signals. Inverse-QMF is used here. In the case of multi-stage QMF, several stages of inverse transforms have to be carried out.

Second Embodiment

Figure 2:
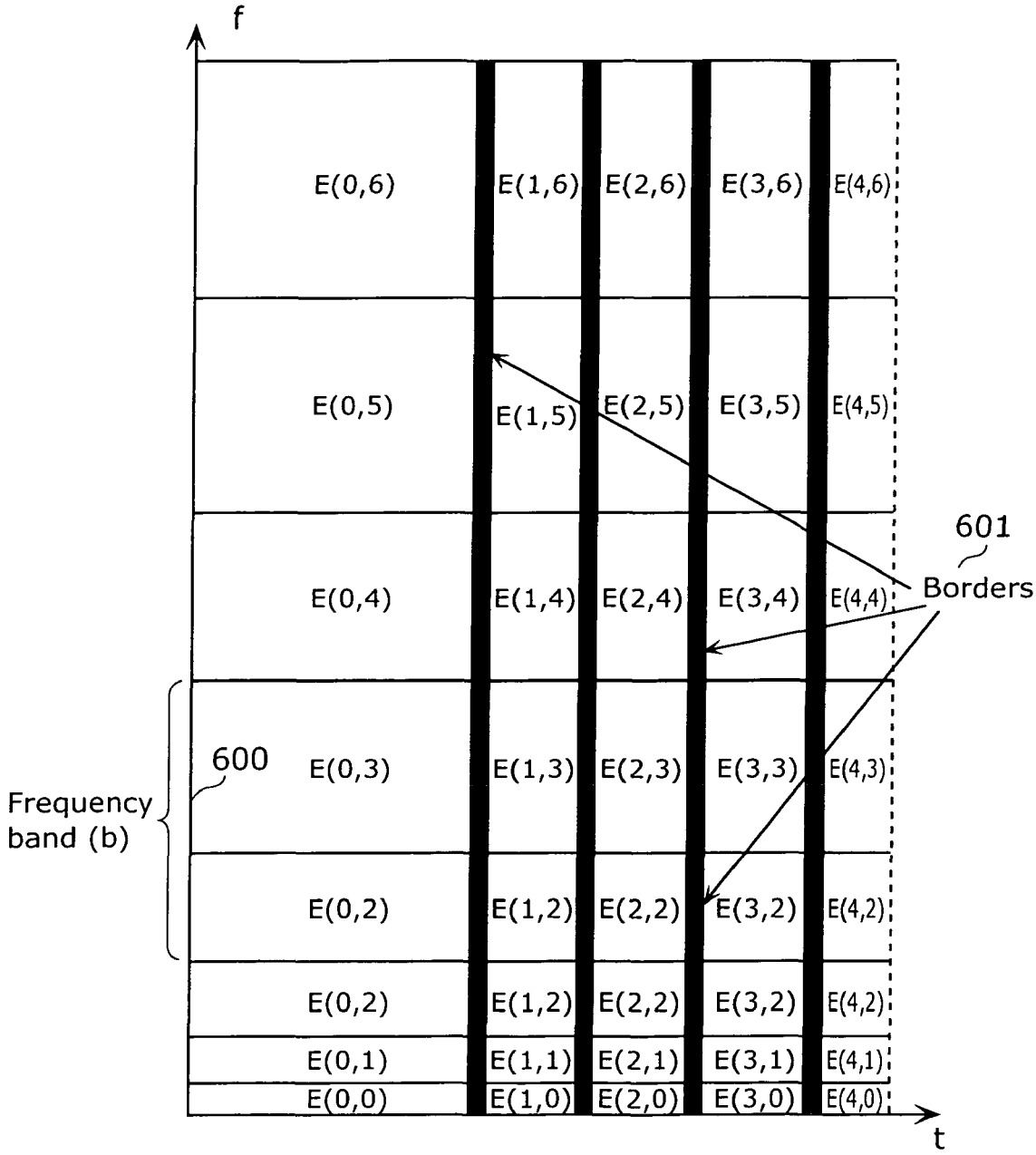
FIG. 2 is a diagram which shows a conventional and typical time segmentation method for various frequency sections.

The second embodiment is related to the energy envelop analysis module (104) shown in FIG. 3. The example of a segmentation method shown in FIG. 2 does not exploit the psychoacoustic properties of the ear. In the present embodiment, as shown in FIG. 4, finer segmentation is carried out for the lower frequency and coarse segmentation is carried out for the high frequency, exploiting the ear's insensitivity to high frequency sound.

To achieve this segmentation, the frequency band of L(t, f) is further divided into "sections" (402). FIG. 4 shows three sections: a section 0 (402) to a section 2 (404). For example, for the section (404) at the high frequency, only one border is allowed at most, which splits this frequency section into two parts. To further save the number of bits, no segmentation is allowed in the highest frequency section. In this case, the famous "Intensity Stereo" used in the conventional arts is applied in this section. The segmentation becomes finer toward the lower frequency sections, to which the ear becomes more sensitive.

The section borders may be a part of the side information, or they may be predetermined according to the coding bit rate. The time borders (406) for each section, however, are to become a part of the side information BorderL.

It should be noted that it is not necessary for the first border of a current frame to be the starting border of the frame. Two consecutive frames may share the same energy envelope across the frame border. In this case, buffering of two audio frames is necessary to allow such processing.

Third Embodiment

Figure 6:
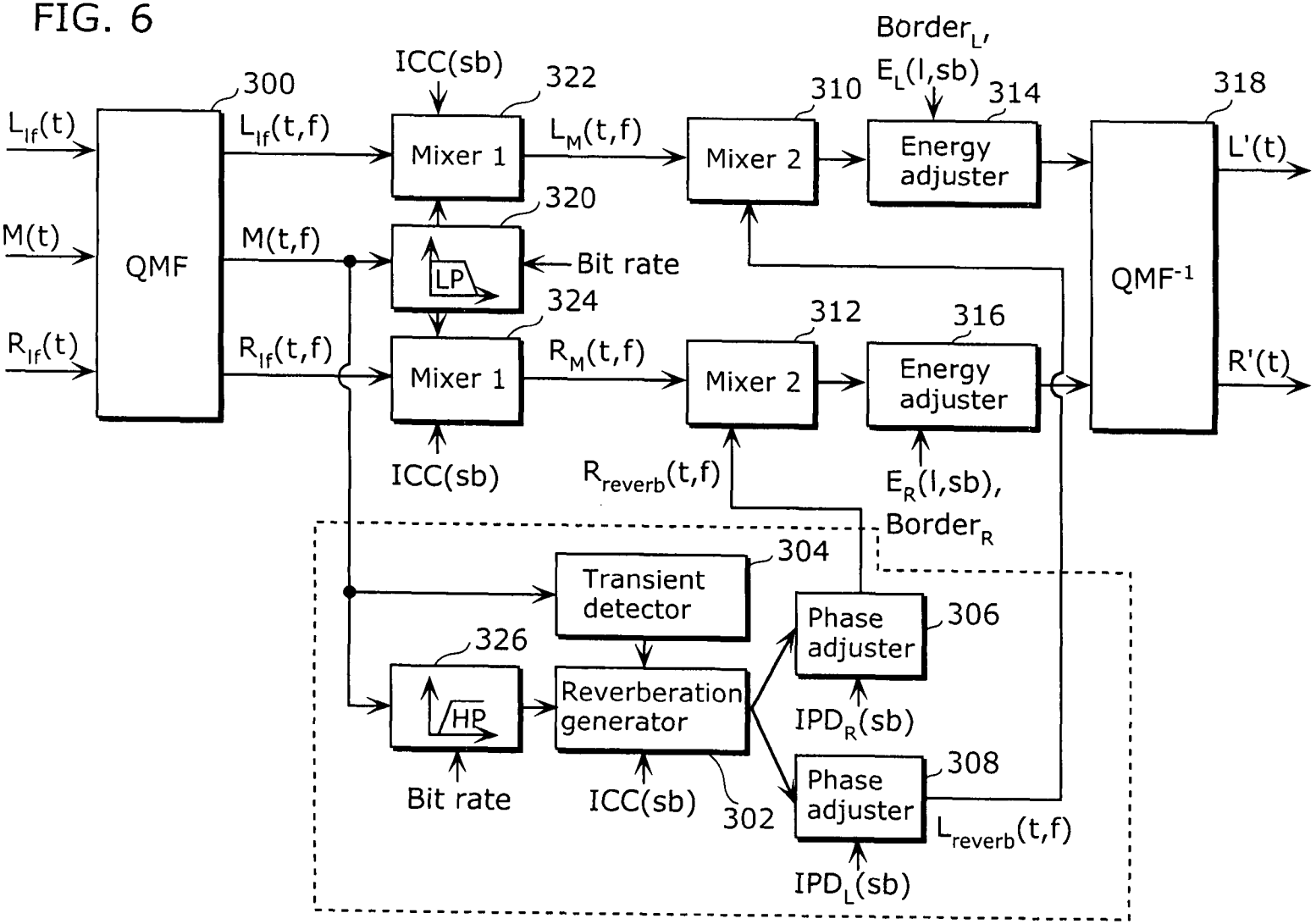
FIG. 6 is a block diagram which shows a configuration of a decoding device according to the third embodiment of the present invention.

For high bit rates, only deriving multi-channel signals using reverberation signals is not good enough to achieve the clear sound level expected at high bit rates. Therefore, in the third embodiment, coarsely quantized difference signals Llf (t) and Rlf(t) are coded separately from a downmix signal and transmitted to the decoding device, and the decoding device corrects the differences between the original audio channel signals and the audio channel signals separated from the downmix signal. FIG. 6 is a block diagram which shows a configuration of a decoding device of the third embodiment. In FIG. 6, a section surrounded by a dashed line is a signal separation unit in which the reverberation generator 302 separates, from a downmix signal, Lreverb and Rreverb for adjusting the phases of premixing channel signals obtained by premixing in the mixers (322, 324). This decoding device includes the above signal separation unit, a transform module (300), mixers 1 (322, 324), a low-pass filter (320), mixers 2 (310, 312), energy adjusters (314, 316), and an inverse-transform module (318). The decoding device of the third embodiment illustrated in FIG. 6 mixes coarsely quantized multi-channel signals and reverberation signals in the low frequency region. They are coarsely quantized due to bit rate constraints.

Together with the downmix signal M(t), these coarsely quantized signals Llf(t) and Rlf(t) are transformed into their time-frequency representations Llf(t, f) and Rlf(t, f) respectively in the transform module (300) which is the QMF filterbank. Up to a certain crossover frequency fx determined by the low-pass filter (320), the left mixer 1 (322) and the right mixer 1 (324) which are the premixing modules premix the left channel signal Llf(t, f) and the right channel signal Rlf(t, f) respectively with the downmix signals M(t, f). Thereby, premix channel signals LM(t, f) and RM(t, f) are generated. For example, the mixing can be carried out in the following manner:

$$L_M(t,f)=(1-ICC(b))*L_{lf}(t,f)+ICC(b)*M(t,f)$$

$$R_M(t,f)=(1-ICC(b))*R_{lf}(t,f)+ICC(b)*M(t,f) \quad \text{[Equation 14]}$$

where ICC(b) denotes the correlation between the channels, that is, mixing proportions between Llf(t, f) and Rlf(t, f) respectively and M(t, f). For example, ICC(b)=1 indicates that ICC(b) is coarsely quantized and the time-frequency representations of Llf(t, f) and Rlf(t, f) respectively are very similar to M(t, f). In other words, when ICC(b)=1, mixing channel signals LM(t, f) and RM(t, f) can be reconstructed sufficiently precisely using only M(t, f).

The remaining processing steps for the frequency region above the crossover frequency fx are the same as the second embodiment shown in FIG. 4. One possible method to coarsely quantize Llf(t) and Rlf(t) is to compute the following difference signals for Llf(t) and Rlf(t):

$$L_{lf}(t)=L(t)-M(t)$$

$$R_{lf}(t)=R(t)-M(t) \quad \text{[Equation 15]}$$

and to code only the major frequency components up to the frequency fx as determined by a psychoacoustic model. As a suggestion to further reduce the bit rate, predetermined quantization steps can be employed. Note that in the above equation 15, Llf(t)=L(t)−M(t) and Rlf(t)=R(t)−M(t) are computed as difference signals, but the present invention is not limited to these computations. For example, respective separated channel signals, instead of M(t) in the above equation 15, may be subtracted. To be more specific, the signal differences may be corrected by computing Llf(t)=L(t)−Lreverb(t) and Rlf(t)=R(t)−Rreverb(t) and then adding Llf(t) and Rlf(t) to the respective separated channel signals.

The crossover frequency fx adopted by the low-pass filter (320) and the high-pass filter (326) is a bit rate function. In the extreme case of a very low bit rate, mixing cannot be carried out due to a lack of bits to quantize Llf(t) and Rlf(t). This is the case, for example, where fx is zero. In the third embodiment, binaural cue coding is carried out only for the frequency range higher than fx.

Figure 7:
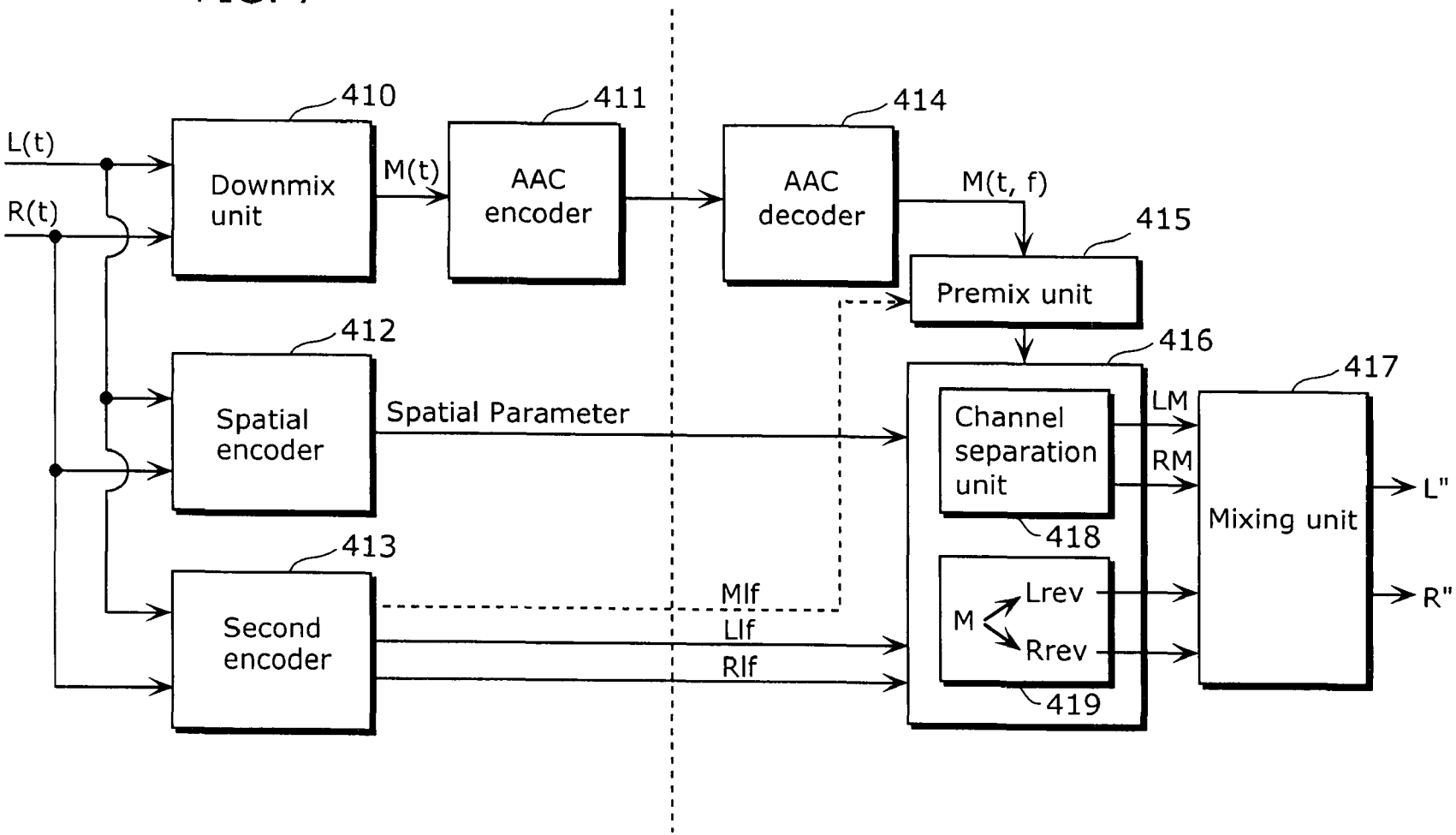
FIG. 7 is a block diagram which shows a configuration of a coding system according to the third embodiment of the present invention.

FIG. 7 is a block diagram which shows a configuration of a coding system including the coding device and the decoding device according to the third embodiment. The coding system in the third embodiment includes: in the coding side, a downmix unit (410), an AAC encoder (411), a binaural cue encoder (412) and a second encoder (413); and in the decoding side, an AAC decoder (414), a premix unit (415), a signal separation unit (416) and a mixing unit (417). The signal separation unit (416) includes a channel separation unit (418) and a phase adjustment unit (419).

The downmix unit (410) is, for example, the same as the downmix unit (102) as shown in FIG. 1. For example, the downmix unit (410) generates a downmix signal represented as M(t)=(L(t)+R(t))/2. In the AAC encoder (411), the downmix signal M(t) generated as such modified-discrete-cosine transformed (MDCT), quantized on a subband basis, variable-length coded, and then incorporated into a coded bitstream.

The binaural cue encoder (412) once transforms the audio channel signals L(t) and R(t) as well as M(t) into time-frequency representations through QMF, and then compares between these respective channel signals so as to compute binaural cues. The binaural cue encoder (412) codes the computed binaural cues and multiplexes them with the coded bitstream.

The second encoder (413) computes the difference signals Llf(t) and Rlf(t) between the right channel signal R(t) and the left channel signal L(t) respectively and the downmix signal M(t), for example, as shown in the equation 15, and then coarsely quantizes and codes them. The second encoder (413) does not always need to code the signals in the same coding format as does the AAC encoder (411).

The AAC decoder (414) decodes the downmix signal coded in the AAC format, and then transforms the decoded downmix signal into a time-frequency representation M(t, f) through QMF.

The signal separation unit (416) includes the channel separation unit (418) and the phase adjustment unit (419). The channel separation unit (418) decodes the binaural cue parameters coded by the binaural cue encoder (412) and the difference signals Llf(t) and Rlf(t) coded by the second encoder (413), and then transforms the difference signals Llf(t) and Rlf(t) into time-frequency representations. After that, the channel separation unit (418) premixes the downmix signal M(t, f) which is the output of the AAC decoder (414) and the difference signals Llf(t, f) and Rlf(t, f) which are the transformed time-frequency representations, for example, according to ICC(b), and outputs the generated premix channel signals LM and RM to the mixing unit 417.

After generating and adding the reverberation components necessary for the downmix signal M(t, f), the phase adjustment unit (419) adjusts the phase of the downmix signal, and outputs it to the mixing unit (417) as phase adjusted signals Lrev and Rrev.

As for the left channel, the mixing unit (417) mixes the premix channel signal LM and the phase adjusted signal Lrev, performs inverse-QMF on the resulting mixed signal, and outputs an output signal L" represented as a time function. As for the right channel, the mixing unit (417) mixes the premix channel signal RM and the phase adjusted signal Rrev, performs inverse-QMF on the resulting mixed signal, and outputs an output signal R" represented as a time function.

Note that also in the coding system as shown in the above FIG. 7, the left and right difference signals Llf(t) and Rlf(t) may be considered as the differences between the original audio channel signals L(t) and R(t) and the output signals Lrev(t) and Rrev(t) obtained by the phase adjustment. In other words, Llf(t) and Rlf(t) may be obtained by the equations Llf(t)=L(t)-Lrev(t) and Rlf(t)=R(t)-Rrev(t).

INDUSTRIAL APPLICABILITY

The present invention can be applied to a home theater system, a car audio system, and an electronic gaming system and the like.

The invention claimed is:

1. An audio signal decoding device which decodes a downmix channel signal obtained by downmixing audio channel signals, into the audio channel signals, said audio signal decoding device comprising:

a downmix channel signal transformation unit that transforms the downmix channel signal into a time-frequency representation over plural frequency bands segmented along a frequency axis;

an audio channel signal transformation unit that transforms the audio channel signals into time-frequency representations, each of the audio channel signals being coded after a part of the audio channel signal within a frequency range up to a predetermined upper frequency limit is quantized to a low-bit signal;

a premixing unit that premixes, for each of the frequency bands, the transformed downmix channel signal and the transformed audio channel signals so as to generate premix channel signals, the premixing being performed within the frequency range up to the predetermined upper frequency limit;

a mixing unit that mixes, for each of the frequency bands, the downmix channel signal, on which a predetermined process is performed based on spatial audio information which indicates a spatial property between the audio channel signals, with the generated premix channel signals so as to generate mixed channel signals, the mixing being performed in a frequency range higher than the predetermined upper frequency limit; and a mixed channel signal transformation unit that transforms the mixed channel signals into the audio channel signals.

2. The audio signal decoding device according to claim 1, wherein the spatial audio information is given to each region delimited by a border in a time direction and a border in a frequency direction.

3. The audio signal decoding device according to claim 2, wherein the number of borders in the time direction varies depending on each section delimited in the frequency direction.

4. The audio signal decoding device according to claim 1, wherein the spatial audio information further includes a component indicating an inter-channel coherence, and said mixing unit performs the mixing in a proportion indicated by the component indicating the inter-channel coherence.

5. The audio signal decoding device according to claim 4, wherein the predetermined process performed based on the spatial audio information includes a process to generate and add a reverberation component to the downmix channel signal, and the process to generate the reverberation component is controlled by the component indicating the inter-channel coherence.

6. The audio signal decoding device according to claim 1, wherein an energy of each of the mixed channel signals is computed so as to derive gain coefficients of the mixed channel signals for all the frequency bands, and each of the gain coefficients is multiplied to the mixed channel signal in each of the frequency bands.

7. The audio signal decoding device according to claim 1, wherein said downmix channel signal transformation unit and said audio channel signal transformation unit are a quadrature mirror filter (QMF) unit, and said mixed channel signal transformation unit is an inverse QMF unit.

8. The audio signal decoding device according to claim 4, wherein the upper frequency limit is determined according to a coding bit rate.

9. An audio signal coding device which codes audio channel signals together with spatial audio information indicating a spatial property between the audio channel signals, said audio signal coding device comprising:

a downmixing unit that downmixes the audio channel signals so as to generate a downmix channel signal;

a signal transformation unit that transforms the audio channel signals and the generated downmix channel signal into time-frequency representations over plural frequency bands segmented along a frequency axis;

a spatial audio information computation unit that compares the audio channel signals in each of predetermined time-frequency regions, and computes the spatial audio information;

a first coding unit that codes the downmix channel signal and the spatial audio information; and a second coding unit that codes the audio channel signals, a band component of each of the audio channel signals being coded after a part of the audio channel signal within a frequency range up to a predetermined upper frequency limit is quantized to a low-bit signal.

10. The audio signal coding device according to claim 9, wherein a time border of each time-frequency region is placed at a temporal location at which there is a sharp change in an energy of each of the audio channel signals or the downmix channel signal.

11. The audio signal coding device according to claim 9, wherein the spatial audio information is computed for each region delimited by a border in a time direction and a border in a frequency direction.

12. The audio signal coding device according to claim 9, wherein among components of the spatial audio information, a component indicating a difference in time for a sound to reach both ears is computed for each of bands of the audio channel signals.

13. The audio signal coding device according to claim 9, wherein among components of the spatial audio information, a component indicating a coherence between the audio channel signals is computed as a correlation between the audio channel signals.

14. An audio signal decoding method of decoding a downmix channel signal obtained by downmixing audio channel signals, into the audio channel signals, said audio signal decoding method comprising:

transforming, using a downmix channel signal transformation unit, the downmix channel signal into a time-frequency representation over plural frequency bands segmented along a frequency axis;

transforming, using an audio channel signal transformation unit, the audio channel signals into time-frequency representations, each of the audio channel signals being coded after a part of the audio channel signal within a frequency range up to a predetermined upper frequency limit is quantized to a low-bit signal;

premixing, using a premixing unit, for each of the frequency bands, the transformed downmix channel signal and the transformed audio channel signals so as to generate premix channel signals, the premixing being performed within the frequency range up to the predetermined upper frequency limit;

mixing, using a mixing unit, for each of the frequency bands, the downmix channel signal, on which a predetermined process is performed based on spatial audio information which indicates a spatial property between the audio channel signals, with the generated premix channel signals so as to generate mixed channel signals, the mixing being performed in a frequency range higher than the predetermined upper frequency limit; and transforming, using a mixed channel signal transformation unit, the mixed channel signals into the audio channel signals.

15. An audio signal coding method of coding audio channel signals together with spatial audio information indicating a spatial property between the audio channel signals, said audio signal coding method comprising:

downmixing, using a downmixing unit, the audio channel signals so as to generate a downmix channel signal;

transforming, using a signal transformation unit, the audio channel signals and the generated downmix channel signal into time-frequency representations over plural frequency bands segmented along a frequency axis;

comparing, using a spatial audio information computation unit, the audio channel signals in each of predetermined time-frequency regions, and computing the spatial audio information;

coding, using a first coding unit, the downmix channel signal and the spatial audio information; and coding, using a second coding unit, the audio channel signals, a band component of each of the audio channel signals being coded after a part of the audio channel signal within a frequency range up to a predetermined upper frequency limit is quantized to a low-bit signal.

* * * * *